US005259231A

United States Patent [19]

Kutschker

[11] Patent Number: 5,259,231

[45] Date of Patent: Nov. 9, 1993

[54] PROCESS FOR THE TWO-DIRECTIONAL BENDING OF SHEET METAL

[75] Inventor: Wolfgang Kutschker, Böblingen, Fed. Rep. of Germany

[73] Assignee: Reinhardt Maschinenbau GmbH, Sindelfingen, Fed. Rep. of Germany

[21] Appl. No.: 842,358

[22] PCT Filed: Aug. 30, 1990

[86] PCT No.: PCT/EP90/01446

§ 371 Date: Mar. 25, 1992

§ 102(e) Date: Mar. 25, 1992

[87] PCT Pub. No.: WO91/06383

PCT Pub. Date: May 16, 1991

[51] Int. Cl.[5] ..... B21D 5/04

[52] U.S. Cl. ..... 72/319; 72/307

[58] Field of Search ..... 72/319-323, 72/306, 307, 388

[56] References Cited

U.S. PATENT DOCUMENTS 4,768,367 9/1988 Favrin ..... 72/319

FOREIGN PATENT DOCUMENTS 353680 2/1990 European Pat. Off. ..... 72/319
1915519 8/1964 Fed. Rep. of Germany .
3837603 5/1990 Fed. Rep. of Germany ..... 72/319
655613 7/1963 Italy ..... 72/306
8203340 3/1984 Netherlands ..... 72/319

*Primary Examiner*—Daniel C. Crane
*Attorney, Agent, or Firm*—Shenier & O'Connor

[57] ABSTRACT

A swivel bending machine (10) for a metal sheet (4) in which a first driving unit (12) is adapted to move upper (2) and lower (1) jaws relative to each other to clamp the metal sheet (4) therebetween with a section (5) of the metal sheet protruding beyond the first and second jaws and in which a bending jaw (3) having two endfaces is mounted on the machine frame for rotation around a stationary swivel axis (S) is driven by a second driving unit to engage the protruding section (5) of the metal sheet (4) to bend the section (5) upon rotation of the metal sheet and wherein at each of the two endfaces of the bending jaw (3) a first supporting element in the form of a swing arm (14) for the bending jaw (3) is provided between said bending jaw (3) and the machine frame (11), said swing arm (14) being adapted to be swivelled about said swivel axis (S) of the bending jaw (3) by said second driving unit (13), a second supporting element (16) for the bending jaw (3) is mounted movably on said swing arm (14) and being movable by a third driving unit (22) relatively to the swing arm in a predetermined direction (E); the bending jaw (3) is supported and guided in a straight-line configuration on said second supporting element (16) and driven by a fourth driving unit (18) in an adjusting direction (I, C) perpendicular to said swivel axis (S); and the direction (E), in which the second supporting element (16) is movable relatively to said swing arm (14), extends perpendicular to a plane being defined by said swivel axis (S) and said straight-line adjusting direction (I, C) of the bending jaw (3).

1 Claim, 4 Drawing Sheets

PROCESS FOR THE TWO-DIRECTIONAL BENDING OF SHEET METAL

The invention relates to a swivel bending machine for a metal sheet.

With the known sheet metal bending machines which have hitherto been used to perform such a process, the bending jaw is only usable in one working direction, i.e., for example, during swivel movement from the bottom upwards in the clockwise direction. Consequently, for sheet metal bending in opposite directions, i.e., when a first sheet metal section is to be bent, for example, in the clockwise direction and subsequently a further sheet metal section in the counter-clockwise direction, the metal sheet has to be turned between the individual bending operations. However, particularly when large metal sheets of several meters length have to be turned so that their top side becomes the bottom side, this is an inconvenient and time-consuming operation which is often also impeded by automatic handling devices provided on the sheet metal bending machine.

The object of the invention is to so improve a generic process that turning of the metal sheet between two two-directional bending operations can be avoided.

A swivel bending machine comprising machine frame, lower jaw, upper jaw and bending jaw for performing the process according to the invention is characterized in that there is provided on each of the two end faces of the bending jaw a first swing arm which can be swivelled about the swivel axis of the bending jaw, in that there is movably mounted on the first swing arm a second swing arm, and in that there is provided on the second swing arm a guide means which permits an essentially straight-line movement of the bending jaw extending perpendicular to the swivel axis, the bending jaw itself extending essentially perpendicular to the direction of movement of the second swing arm.

Figure 7:
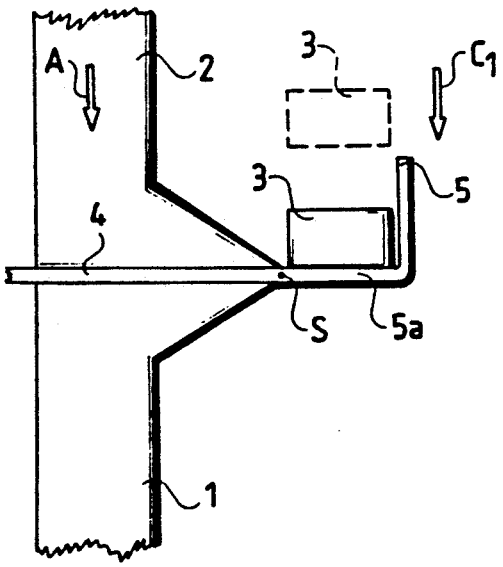
Figure 8:
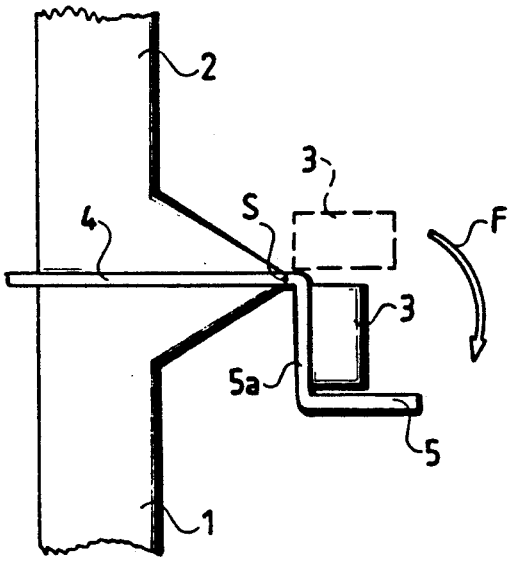
Figure 9:
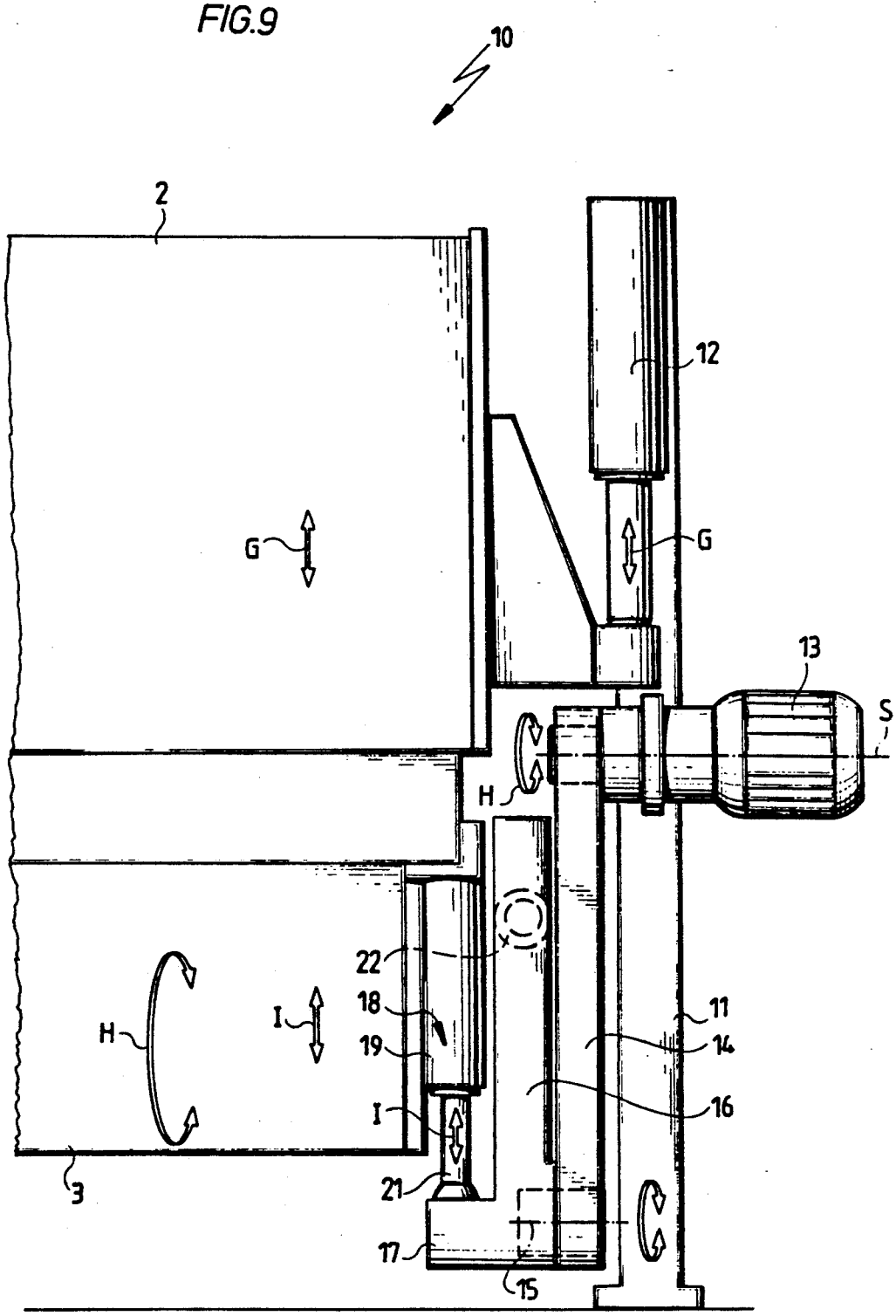

The following description of preferred embodiments serves in conjunction with the appended drawings to explain the invention in further detail. The drawings show:

FIGS. 1 to 8 several subsequent steps in the two-directional bending of a metal sheet and FIG. 9 a device for performing two-directional sheet metal bending according to FIGS. 1 to 8.

Figure 10:
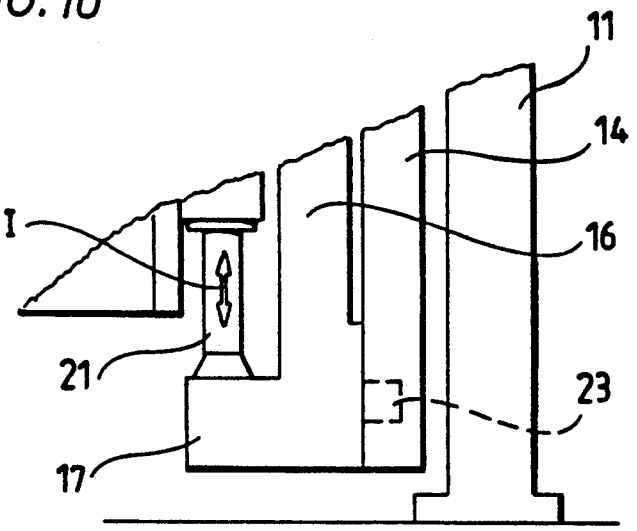

FIG. 10 is a view similar to FIG. 9 illustrating another embodiment.

FIGS. 1 to 8 each show schematically the main parts of a swivel bending machine, namely a lower jaw 1, an upper jaw 2 and a bending jaw 3. The bending jaw 3 is mounted for rotation on the machine frame (not illustrated) and can be swivelled about a swivel axis S extending perpendicular to the drawing plane in FIGS. 1 to 8.

A metal sheet 4 is clamped between lower jaw 1 and upper jaw 2 by lowering the upper jaw 2 in the direction of the arrow A and protrudes with a sheet metal section 5 beyond the jaws 1, 2. The bending jaw 3 engages with its upper or bending surface the underside of the sheet metal section 5. This side is also referred to hereinafter as the first side of the metal sheet 4; it lies opposite the top or second side of the metal sheet 4.

Figure 1:
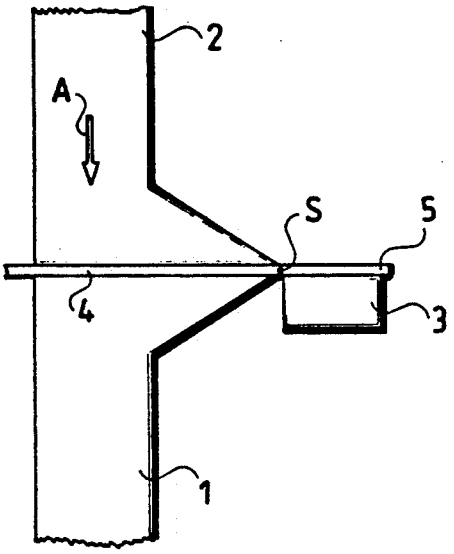
Figure 2:
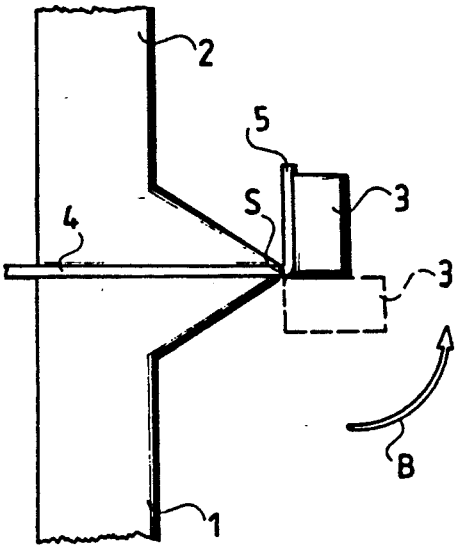

FIG. 1 represents the initial state of the bending process. In a first bending step, the bending jaw 3—cf. FIG. 2—is swivelled upwards (arrow B) through 90° in the counter-clockwise direction, whereby the sheet metal section 5 is likewise bent upwards in the counter-clockwise direction. The bending jaw 3—cf. FIG. 3—is now withdrawn in a first direction of adjustment (arrow C) perpendicular to its swivel axis S from the bent sheet metal section 5 so that—cf. FIG. 4—it can be swivelled further upwards (arrow D) in an unimpeded manner around this bent sheet metal section 5 until after swivelling through a total of approximately 180° it faces the second or top side of the metal sheet 4. The swivelling of the bending jaw 3 according to FIG. 4 again takes place about its swivel axis S. As is further evident from FIG. 4, the bending jaw 3 is now located above the upper jaw 2 clamping the metal sheet 4 so that upon perpendicular lowering from this position, the bending jaw 3 would come into contact with the upper jaw 2 and not the metal sheet 4. Proceeding from the position according to FIG. 4, the bending jaw 3—cf. FIG. 5—is then moved in a second direction of adjustment along the arrow E until it is outside of the range of the upper jaw 2 and can be lowered onto a protruding sheet metal section which projects between lower jaw 1 and upper jaw 2.

Figure 3:
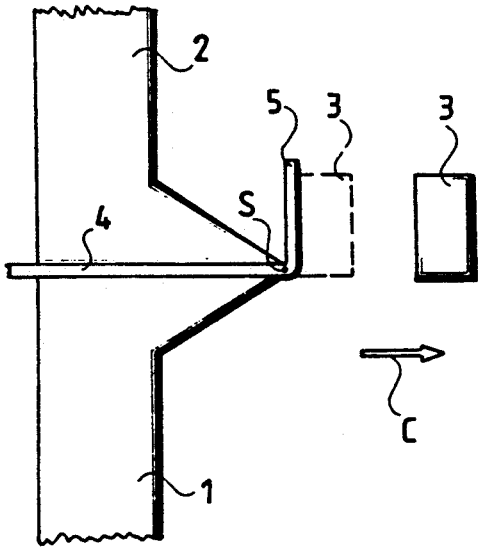
Figure 4:
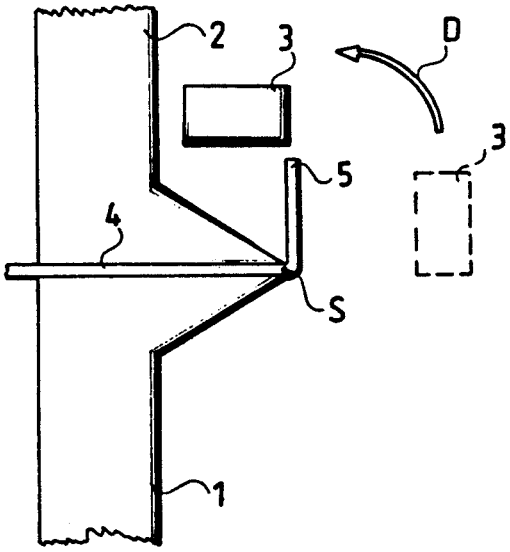
Figure 5:
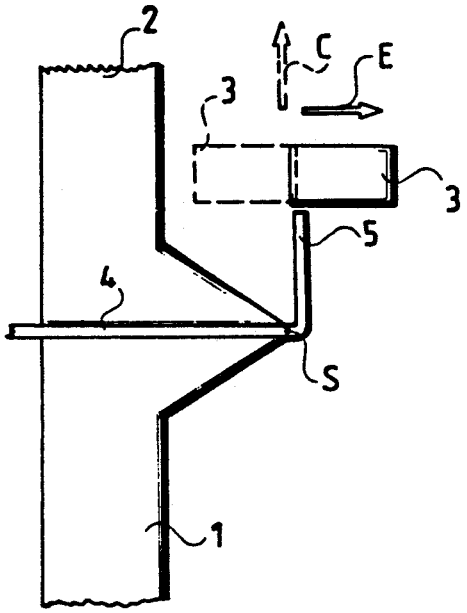

The directions of adjustment of the bending jaw 3 in accordance with the arrows C and E in FIGS. 3 and 5, respectively, now seem to extend parallel to one another. In actual fact, the arrow C always runs parallel to the small side and the arrow E always parallel to the large side of the rectangle schematically representing the bending jaw 3 in the drawings. Hence the two directions of adjustment according to the arrows C and E always stand perpendicular on one another, and in the transition from FIG. 3 to FIGS. 4 and 5, the arrow C has likewise swivelled through 90°, as indicated in dashed lines in FIG. 5.

In order to define the spatial position of the second direction of adjustment in accordance with arrow E, one can also say that this direction of adjustment (arrow E) extends perpendicular to the plane containing the first direction of adjustment (arrow C) and the swivel axis S. This plane extends in FIG. 5 perpendicular to the drawing plane and parallel to the arrow C.

Figure 6:
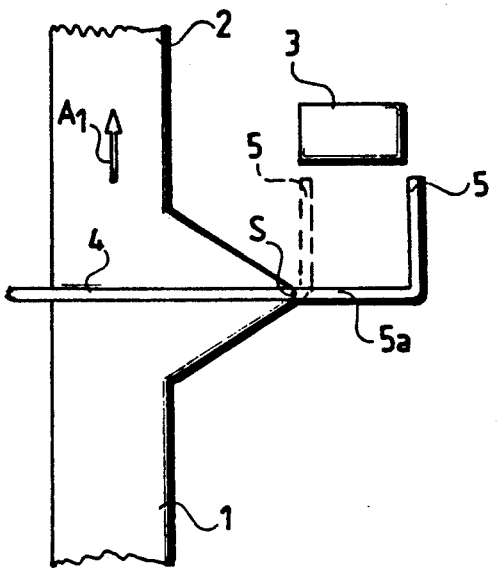

When the bending jaw 3 has reached the position illustrated in FIG. 5, the upper jaw 2 is raised accordingly (arrow $A_1$)—cf. FIG. 6—and the metal sheet 4 is advanced to the right so that there is again a protruding sheet metal section 5*a* adjacent to the sheet metal section 5 which has already been bent. When the metal sheet 4 has been pushed forward into the position according to FIG. 6, the upper jaw 2 is lowered again (arrow A) and the metal sheet 4 clamped between lower jaw 1 and upper jaw 2. Thereupon—cf. FIG. 7—the bending jaw 3 is placed against the top or second side of the metal sheet by displacement in the direction of arrow $C_1$. The direction of adjustment corresponding to the arrow $C_1$ is parallel to the arrow C but runs in the opposite direction.

Finally, as shown in FIG. 8, by swivelling the bending jaw 3 through 90° in the direction of the arrow F downwards or in the clockwise direction, the sheet metal section 5*a* is bent in the opposite direction to the sheet metal section 5. The metal sheet 4 thus bent in the opposite direction at its rim can now be removed from the swivel bending machine. By corresponding adjustment of the bending jaw 3 along arrows E and F, the swivel bending machine is brought back into its initial position according to FIG. 1.

For the performance of the inventive sheet metal bending process explained with reference to FIGS. 1 to 8, it is essential that the bending jaw 3 engage the first side of the metal sheet during the first bending operation and the second side of the metal sheet during the second bending operation, as is evident from FIGS. 1 and 7, respectively. To this end, adjustment of the bending jaw 3 in the first direction of adjustment (along arrow C; FIG. 3) is necessary to enable transfer of the bending jaw 3 away from the bent sheet metal section 5 from the first to the second side of the metal sheet. However, since the bending jaw 3 (cf. FIG. 4) thereby moves over the projecting part of the upper jaw 2, the bending jaw 3 has to be additionally adjusted (cf. FIG. 5) in the second direction of adjustment in the direction of arrow E so that it can again be positioned (cf. FIG. 7) on a sheet metal section 5*a* protruding between lower jaw and upper jaw. These two reciprocating movements for adjustment of the bending jaw 3 which stand perpendicular on one another in accordance with arrows C, $C_1$ and E are thus essential to the inventive process and, in the end, ensure that two-directional sheet metal bending is possible without turning the metal sheet FIG. 9 shows schematically a swivel bending machine 10 which is structurally designed such that the bending process explained with reference to FIGS. 1 to 8 can be performed on it. FIG. 9 shows in a front view only the right side of such a swivel bending machine 10. The other side is of corresponding mirror-inverted design.

The upper jaw 2 and the bending jaw 3 which are mounted on a machine frame are illustrated in FIG. 9. The bending jaw 3 which can be swivelled about the swivel axis S covers in FIG. 9 the lower jaw 1 which is likewise mounted on the machine frame 11 and is visible in FIGS. 1 to 8. The upper jaw 2 is movable up and down in the direction of the arrow G which corresponds to the arrows A and $A_1$ in FIGS. 1 and 6, respectively, to clamp and release the metal sheet 4. To this end, the upper jaw 2 is connected to a hydraulic cylinder 12 attached to the machine frame 11. The swivel movement of the bending jaw 3 about the swivel axis S is indicated in FIG. 9 by the arrows H which correspond to the arrows B, D, F in FIGS. 2, 4 and 8, respectively.

The swivelling of the bending jaw 3 is carried out with the aid of a motor 13 attached to the machine frame 11. The motor 13 engages a first swing arm 14 mounted for swivel movement about the swivel axis S and can swivel it back and forth perpendicular to the drawing plane of FIG. 9. A second swing arm 16 is mounted on the first swing arm 14 for rotation about an axis 15. The axis 15 lies below the swivel axis S. A piston-cylinder-unit 18 is provided between a protruding foot 17 of the second swing arm 16 and the bending jaw 3. Its cylinder 19 is rigidly connected to the bending jaw 3 and its piston rod 21 to the foot 17. The cylinder 19 can be additionally guided in straight-line configuration along arrows I on the second swing arm 16. In this way, the piston-cylinder-unit 18 forms a guide means for the bending jaw 3 such that upon actuation of the unit 18, the bending jaw 3 can be displaced in a straight line relative to the second swing arm 16, away from the swivel axis S or towards this axis. This first adjusting movement of the bending jaw 3 is illustrated by the arrows I which correspond to the arrows C, $C_1$ in FIGS. 3 and 7, respectively.

The second adjusting movement mentioned hereinabove which takes place perpendicular to the plane containing the first direction of adjustment I and the swivel axis S (drawing plane of FIG. 9) is implemented with the aid of the second swing arm 16. When the second swing arm 16 is swivelled about the axis 15 with the aid of a drive motor 22 indicated in dashed lines in FIG. 9, the bending jaw 3 or at least its working surface engaging the metal sheet to be bent is adjusted perpendicular to the drawing plane of FIG. 9 in accordance with arrow E in FIG. 5. While the arrow E in FIG. 5 is shown as being straight when the bending jaw 3 rotates around the axis 15 shown in FIG. 9, the motion of the jaw will be along a slightly curved path. However, as is pointed out hereinbelow, it is contemplated that the second swing arm 16 could be slidably connected to the first swing arm 14 by a straight-line guide means.

It is possible for the straight-line guide means formed by the piston-cylinder-unit 18 in the embodiment according to FIG. 9 to also be designed in a different way, for example, by a sliding guide means for the bending jaw 3, with a separate drive device, for example, an electric motor with a gear spindle, then being allocated to this jaw 3. The second swing arm 16 could—instead being adapted to swivel about the axis 15—also be slidably connected to the first swing arm 14 in a different way, for example, likewise by a straight-line guide means, as indicated at 23 in FIG. 10 for permitting movement of jaw 3 in the direction of arrow E in FIG. 5. In any case, the structural design of the swivel bending machine 10 must ensure that the adjustment of the bending jaw 3 in the first and second directions of adjustment (arrows C and E) explained in detail hereinabove is possible.

I claim:

1. A swivel bending machine (10) for a metal sheet (4) comprising a machine frame (11), a lower jaw (1), an upper jaw (2), a first driving unit (12) for moving said upper and lower jaws relative to each other to clamp said metal sheet (4) therebetween with a section (5) of the metal sheet protruding beyond the upper and lower jaws, a-bending jaw (3) having two endfaces, means mounting said bending jaw on the machine frame (11) for rotation around a stationary swivel axis (5) and a second driving unit for driving said bending jaw, said bending jaw (3) being engageable with the protruding section (5) of said metal sheet (4) to bend said section (5) upon rotation of the bending jaw (3) wherein the improvement comprises:

a first supporting element in the form of a swing arm (14) for the bending jaw (3) between said bending jaw (3) and the machine frame (11) at each of the endfaces of the bending jaw (3), said swing arm (14) being adapted to be swivelled about said swivel axis (S) by said second driving unit (13) to permit bending of said section (S), a second supporting element (16) for the bending jaw (3) mounted on said swing arm (14) for movement relative thereto in a predetermined direction (E), a third driving unit for said second supporting element, means supporting and guiding said bending jaw (3) on said second supporting element for rectilinear movement, a fourth driving unit for driving said bending jaw (3) in an adjusting direction (I, C) perpendicular to said swivel axis (S), said fourth driving unit being mounted on said second supporting element (16) for movement therewith and said direction (E) in which said second supporting element (16) is movable relative to said swing arm (14) extends perpendicular to a plane defined by said swivel axis (S) and the rectilinear adjusting direction (I, C) of the bending jaw (3).

* * * * *

UNITED STATES PATENT AND TRADEMARK OFFICE

CERTIFICATE OF CORRECTION

PATENT NO. : 5,259,231

DATED : November 9, 1993

INVENTOR(S) : WOLFGANG KUTSCHKER

It is certified that error appears in the above-identified patent and that said Letters Patent is hereby corrected as shown below:

Claim 1 - Column 4, line 51 -
delete "(S)", insert -- (5) --.

Signed and Sealed this

Nineteenth Day of April, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,259,231

DATED : November 9, 1993

INVENTOR(S) : Wolfgang Kutschker

It is certified that error appears in the above-identified patent and that said Letters Patent is hereby corrected as shown below:

On title page, insert item [30] to read:

--Foreign Application Priority Data

Fed. Rep. of Germany [DE] 10-26-89 39 35 658--.

Signed and Sealed this

Fourteenth Day of June, 1994

*Attest:*

*Attesting Officer*

BRUCE LEHMAN

*Commissioner of Patents and Trademarks*